US007770724B2

(12) United States Patent
Ghini et al.

(10) Patent No.: US 7,770,724 B2
(45) Date of Patent: Aug. 10, 2010

(54) RIGID, SLIDE-OPEN PACKAGE FOR TOBACCO ARTICLES

(75) Inventors: Marco Ghini, Via Galletta (IT); Stefano Negrini, Calderara di Reno (IT)

(73) Assignee: G.D Societa'per Azioni, Bologna (IT)

( * ) Notice: Subject to any disclaimer, the term of this patent is extended or adjusted under 35 U.S.C. 154(b) by 233 days.

(21) Appl. No.: 12/066,441

(22) PCT Filed: Sep. 11, 2006

(86) PCT No.: PCT/EP2006/066219

§ 371 (c)(1),
(2), (4) Date: Aug. 11, 2008

(87) PCT Pub. No.: WO2007/031484

PCT Pub. Date: Mar. 22, 2007

(65) Prior Publication Data

US 2008/0289977 A1 Nov. 27, 2008

(30) Foreign Application Priority Data

Sep. 12, 2005 (IT) ..... BO2005A0554

(51) Int. Cl.
*B65D 85/10* (2006.01)

(52) U.S. Cl. ..... 206/267; 206/273; 229/125.125

(58) Field of Classification Search ..... 206/267, 206/273, 270, 249; 229/125.01, 125.125, 229/913, 122

See application file for complete search history.

(56) References Cited

U.S. PATENT DOCUMENTS 4,534,463 A * 8/1985 Bouchard ..... 206/267
5,080,227 A 1/1992 Focke et al.
5,682,986 A 11/1997 Cobler
7,377,385 B2 5/2008 Giannini et al.

FOREIGN PATENT DOCUMENTS

CH 313068 3/1956

(Continued)

OTHER PUBLICATIONS

Chinese Office Action in CN 200680037902.6 dated Feb. 12, 2010.

(Continued)

*Primary Examiner*—Ehud Gartenberg
*Assistant Examiner*—Andrew Perreault
(74) *Attorney, Agent, or Firm*—Marshall Gerstein & Borun LLP

(57) ABSTRACT

A rigid package (1) for tobacco articles (3), having a first container (2) housing a group (3) of tobacco articles and in turn housed inside a second container (4) to slide, with respect to the second container (4), between a closed position, in which the first container (2) is fully inserted inside the second container (4), and an open position, in which the first container (2) is partly extracted from the second container (4); the package (1) has two connecting strips (22), each of which is connected, on one side, to a major lateral wall (14) of the first container (2), and, on the opposite side, to a major lateral wall (7) of the second container (4), and has a deformable portion (23) at the first container (2).

28 Claims, 9 Drawing Sheets

FOREIGN PATENT DOCUMENTS

| | | |
|---|---|---|
| CH | 473 012 | 5/1969 |
| CN | 1662433 A | 8/2005 |
| FR | 2 499 947 | 8/1982 |
| GB | 388971 | 3/1933 |
| GB | 2 115 386 | 9/1983 |
| WO | WO-2004/028927 A1 | 4/2004 |

OTHER PUBLICATIONS

International Search Report in PCT/EP2006/066219 dated Dec. 28, 2006.

* cited by examiner

RIGID, SLIDE-OPEN PACKAGE FOR TOBACCO ARTICLES

CROSS REFERENCE TO RELATED APPLICATIONS

This is the U.S. national phase application of International Application No. PCT/EP2006/0066219,filed Sep. 11, 2006, which claims the benefit of Italian patent application No. BO 2005A 000554, filed Sep. 12, 2005.

TECHNICAL FIELD

The present invention relates to a rigid, slide-open package for tobacco articles.

The present invention may be used to particular advantage in a rigid cigarette packet, to which the following description refers purely by way of example.

BACKGROUND ART

Rigid, slide-open cigarette packets are known, such as those described in Patent Application FR 2499947A1, Patent Application WO 2004024595A1, U.S. Pat. Nos. 4,534,463A1, and 5,080,227A1.

A rigid, slide-open cigarette packet comprises a first container, which houses a foil-wrapped group of cigarettes and is housed inside a second container to slide, with respect to the second container, between a closed position, wherein the first container is fully inserted inside the second container, and an open position, wherein the first container is partly extracted from the second container.

Known rigid, slide-open cigarette packets are all formed using two separate blanks: a first blank is folded about the group of cigarettes to form the first container, and a second blank is folded about the first container to form the second container.

Standard cigarette packing machines produce rigid, hinged-lid packets, and are designed to handle one blank for forming a container about the group of cigarettes, and a small collar which need simply be folded into a U about the group of cigarettes. A special packing machine for producing rigid, slide-open packets therefore calls for major alterations, involving high design, construction, and maintenance costs, to a standard rigid, hinged-lid packet machine.

DISCLOSURE OF INVENTION

It is an object of the present invention to provide a rigid, slide-open package for tobacco articles, designed to eliminate the aforementioned drawbacks, and which, in particular, can be produced cheaply and easily using a substantially standard packing machine.

According to the present invention, there is provided a rigid, slide-open package for tobacco articles, as claimed in the accompanying Claims.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Number 1 in the accompanying drawings indicates as a whole a rigid cigarette packet comprising a container 2 housing a group 3 of cigarettes wrapped in a sheet of foil inner wrapping material; and a container 4, which houses container 2 in sliding manner to allow container 2 to slide, with respect to container 4, between a closed position (FIG. 1), in which container 2 is fully inserted inside container 4, and an open position (FIG. 2), in which container 2 is partly extracted from container 4.

Figure 2:
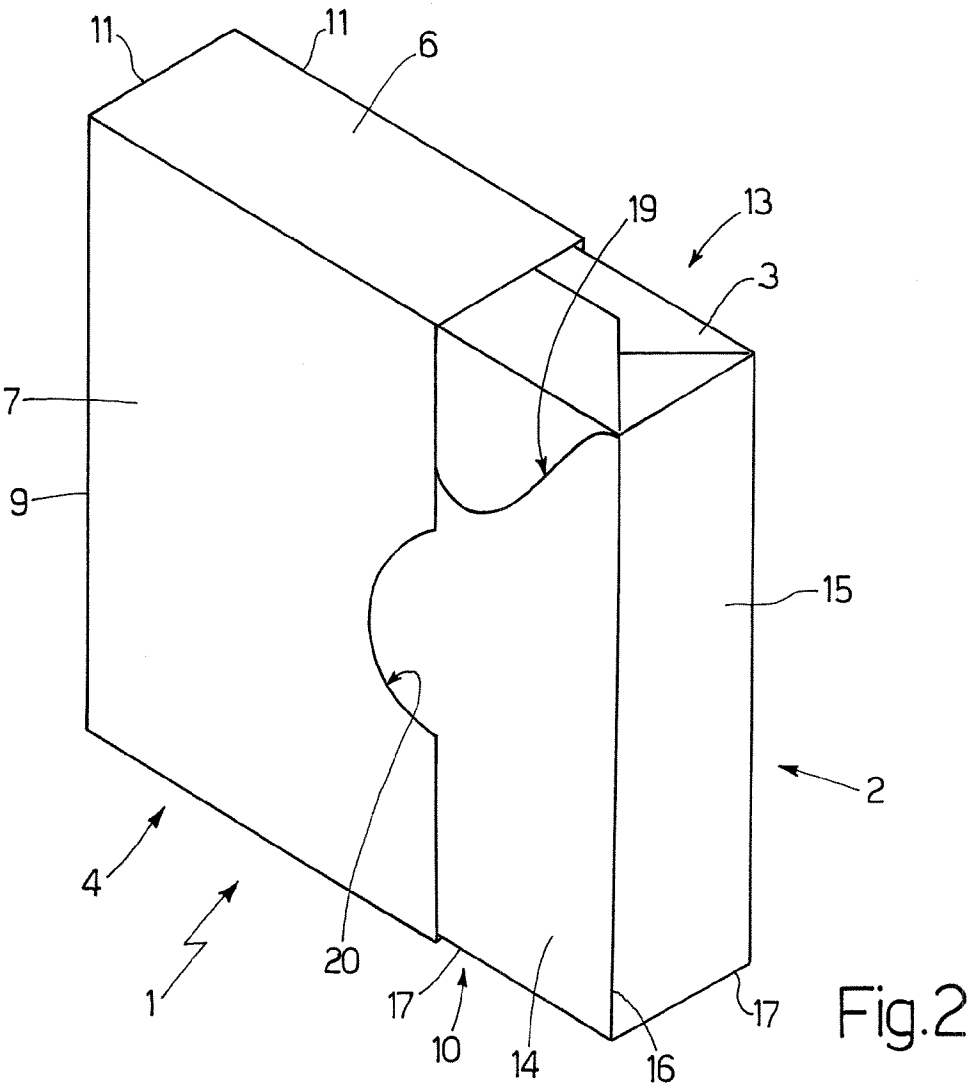
FIG. 2 shows a front view in perspective of the FIG. 1 rigid cigarette packet in an open configuration.
Figure 3:
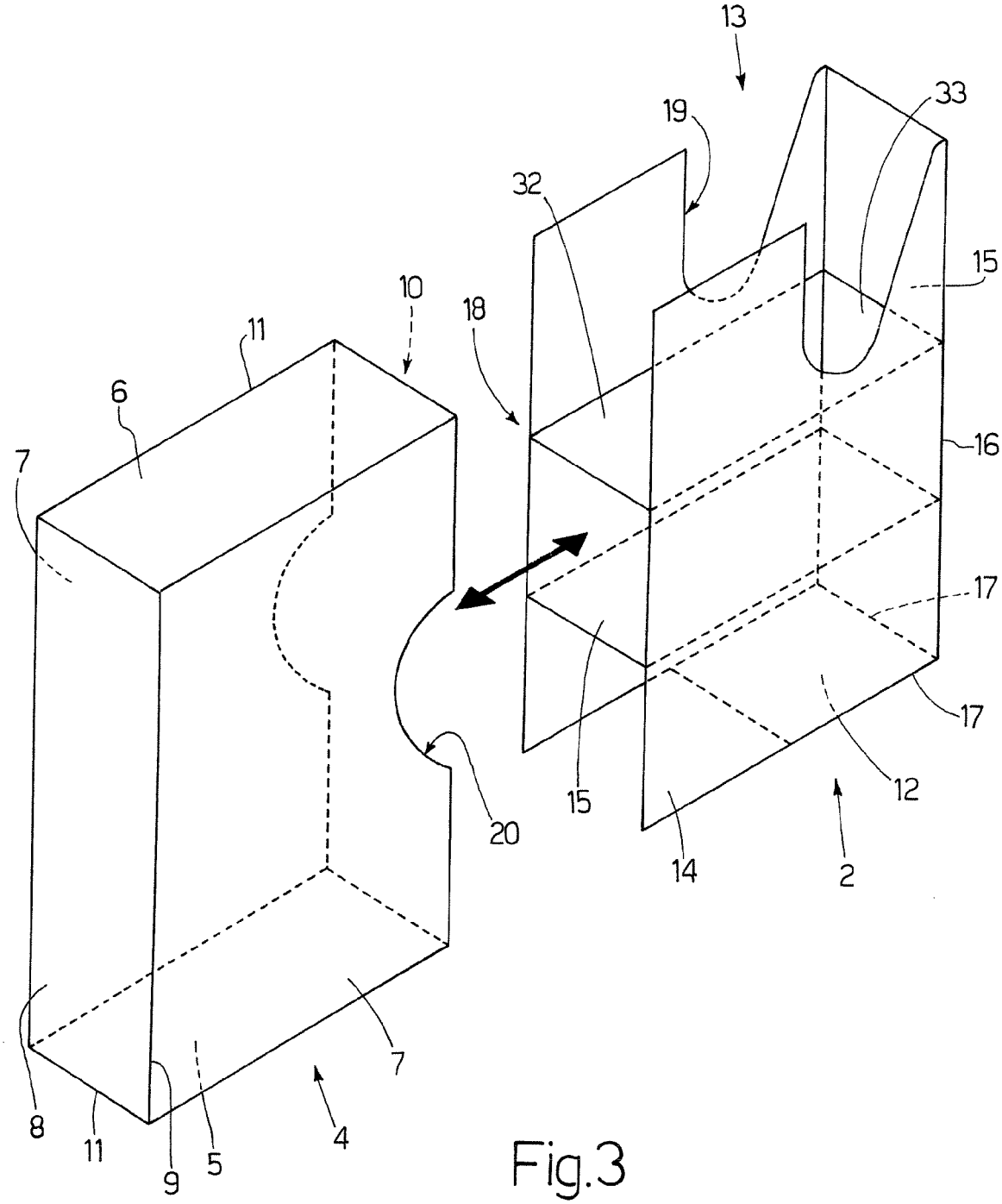
FIG. 3 shows an exploded view in perspective, with parts removed for clarity, of the FIG. 1 rigid cigarette packet.

As shown in FIG. 3, container 4 is parallelepiped-shaped, and comprises a bottom wall 5; a top wall 6; two parallel, opposite, major lateral walls 7; a minor lateral wall 8 separated from major lateral walls 7 by two longitudinal edges 9; and an open end 10 parallel to and opposite minor lateral wall 8, and which permits passage of container 2 between the closed position (FIG. 1) and the open position (FIG. 2). Lateral walls 7 and 8 of container 4 are separated from walls 5 and 6 by transverse edges 11, which are divided into four major transverse edges 11 defined between major lateral walls 7 and walls 5 and 6, and two minor transverse edges 11 defined between minor lateral wall 8 and walls 5 and 6.

Container 2 is parallelepiped-shaped, and comprises a bottom wall 12; an open end 13 parallel to and opposite bottom wall 12; two parallel, opposite, major lateral walls 14; and two parallel, opposite, minor lateral walls 15 separated from major lateral walls 14 by four longitudinal edges 16. Lateral walls 14 and 15 of container 2 are separated from bottom wall 12 by four transverse edges 17, which are divided into two major transverse edges 17 defined between major lateral walls 14 and bottom wall 12, and two minor transverse edges 17 defined between minor lateral walls 15 and bottom wall 12.

The minor lateral wall 15 of container 2 facing open end 10 of container 4 is the same size as minor lateral wall 8 of container 4, and is larger than the minor lateral wall 15 of container 2 facing minor lateral wall 8 of container 4. In the FIG. 1-5 embodiment, the minor lateral wall 15 of container 2 facing minor lateral wall 8 of container 4 is defined by an inner member 18 (shown spread out in FIG. 7), which is looped about group 3 of cigarettes and glued to the inner surface of major lateral walls 14 and/or of the other minor lateral wall 15 of container 2.

Bottom wall 12 of container 2 is smaller than bottom wall 5 of container 4.

Open end 13 of container 2 permits axial withdrawal of the cigarettes in group 3 of cigarettes housed inside container 2, when container 2 is in the open position (FIG. 2). In the embodiments shown in the accompanying drawings, open end 13 covers the whole extension of container 2. In a different embodiment not shown, a top wall of container 2 limits the extension of open end 13. For easy axial withdrawal from container 2 of the cigarettes in group 3 of cigarettes, each major lateral wall 14 of container 2 has a triangular, rounded-tipped recess 19 at the top.

When container 2 is in the closed position (FIG. 1), each lateral wall 7, 8 of container 4 faces and is aligned with a corresponding lateral wall 14, 15 of container 2. More specifically, container 2 is sized to house group 3 of cigarettes with very little clearance, and container 4 is sized to house container 2 with very little clearance, so as to minimize the amount of packing material required to produce containers 2 and 4, and also movement of group 3 of cigarettes inside container, and movement of container 2 inside container 4. Obviously, a certain amount of clearance must be allowed between group 3 of cigarettes and container 2 to enable the user to extract the cigarettes from container 2 without too much difficulty, and the same also applies to the clearance between containers 2 and 4 to enable the user to extract container 2 easily from container 4.

Figure 1:
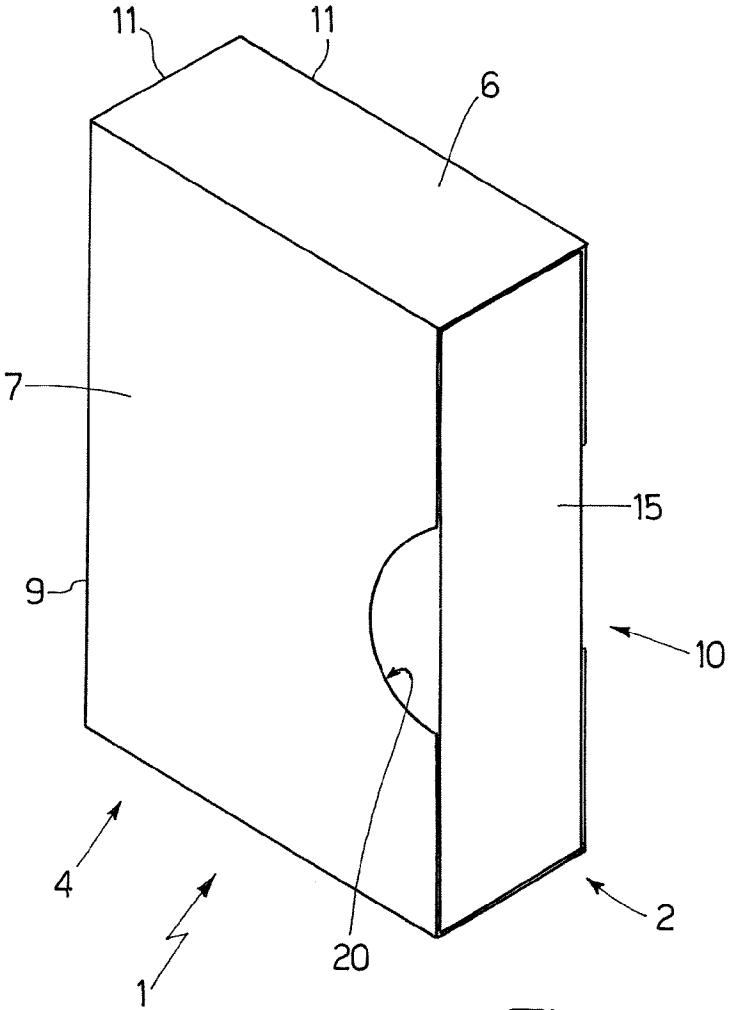
FIG. 1 shows a front view in perspective of a preferred embodiment of a rigid cigarette packet in accordance with the present invention and in a closed configuration.

Each major lateral wall 7 of container 4 has a recess 20 close to open end 10 to facilitate withdrawal of container 2 from container 4 as of the closed position (FIG. 1) by enabling the user to grip and exert pull on major lateral walls 14 of container 2. Alternatively, to facilitate expulsion of container 2 from container 4, minor lateral wall 8 of container 4 has a hole 21 (shown in FIGS. 10 and 11) shaped and sized to enable the user to insert a finger and exert pressure on the minor lateral wall 15 of container 2 facing hole 21, when container 2 is in the closed position (FIG. 1).

Figure 5:
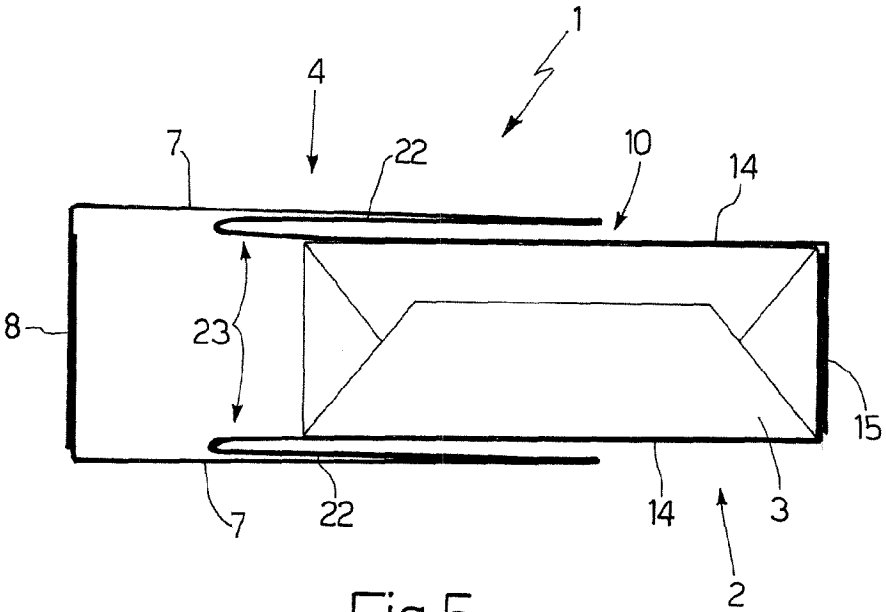
FIGS. 4 and 5 show two sectioned plan views, with parts removed for clarity, of the FIG. 1 rigid cigarette packet in a closed and open configuration respectively.
Figure 4:
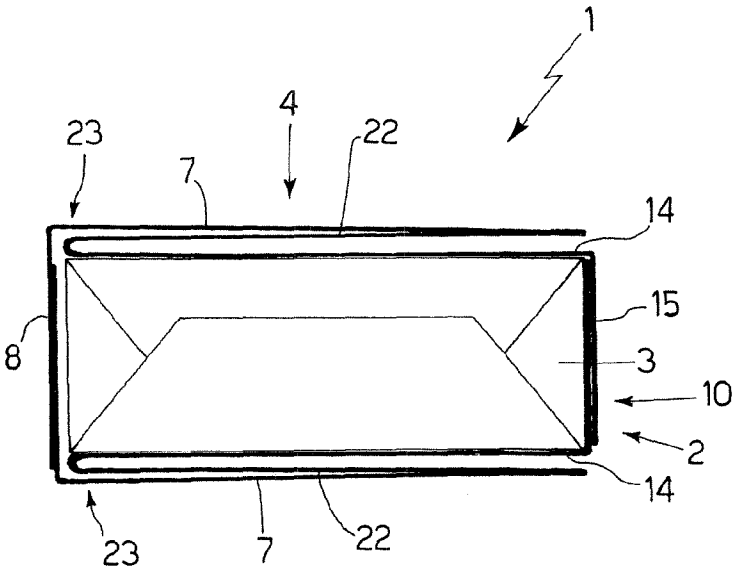

As shown in FIGS. 4 and 5, packet 1 comprises two connecting strips 22, each of which is connected, on one side, to a major lateral wall 14 of container 2, and, on the opposite side, to a major lateral wall 7 of container 4, and comprises a deformable portion 23 at container 2. Deformable portion 23 of each connecting strip 22 has a number of parallel, spaced crease lines 24 (shown in FIG. 6). More specifically, each connecting strip 22 is connected seamlessly to an end edge of major lateral wall 14 of container 2, and is connected seamlessly to an end edge of major lateral wall 7 of container 4.

In a preferred embodiment, each connecting strip 22, with the exception of deformable portion 23, is glued to the inner surface of major lateral wall 7 of container 4.

Figure 6:
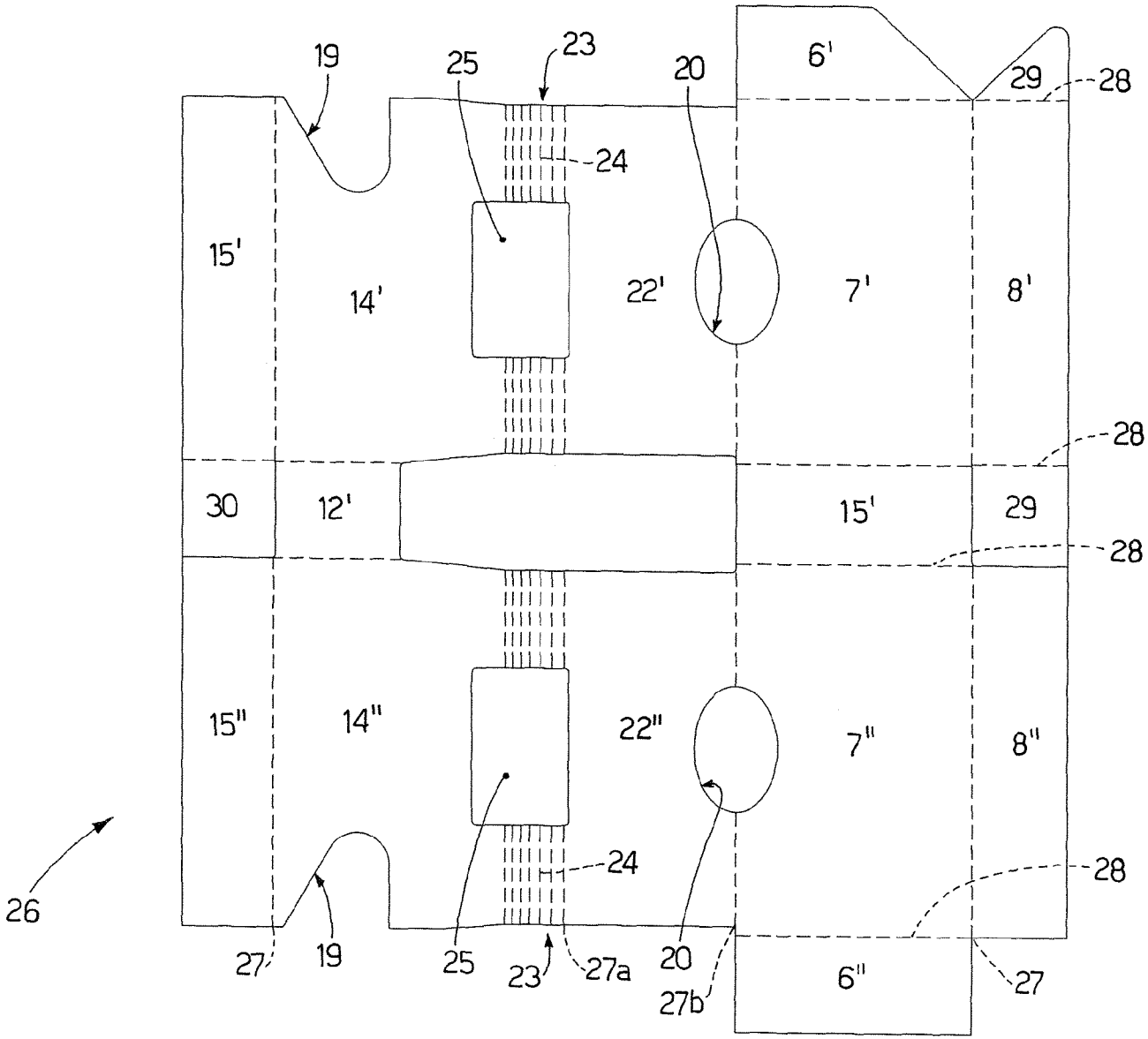
FIG. 6 shows a plan view of a flat blank used to produce the rigid cigarette packet in FIGS. 1-5.

As shown more clearly in FIG. 6, each connecting strip 22 is slightly smaller longitudinally than major lateral walls 7 and 14 of containers 2 and 4, and has a central hole 25 at deformable portion 23. As stated, bottom wall 12 of container 2 is smaller than bottom wall 5 of container 4, and is absent at least at deformable portions 23 of connecting strips 22.

When container 2 is in the closed position (FIG. 4), i.e. is fully inserted inside container 4, deformable portion 23 of each connecting strip 22 is fully extended, assumes a flat configuration, and is parallel to major lateral walls 7 and 14 of containers 2 and 4. When container 2 is in the open position (FIG. 5), i.e. is partly extracted from container 4, deformable portion 23 of each connecting strip 22 assumes a U-shaped configuration. As container 2 moves from the closed position to the open position, deformable portion 23 of each connecting strip 22 is gradually deformed until it eventually reaches a point of maximum deformation, at which container 2 cannot be withdrawn any further from container 4. As such, connecting strips 22 also provide for limiting extraction of container 2 from container 4 and so preventing container 2 from being withdrawn completely from container 4.

As shown in FIG. 6, both containers 2 and 4 are formed from the same flat blank 26, which is substantially rectangular, and the component parts of which are indicated, where possible, using the same reference numbers, with superscripts, as for the corresponding parts of containers 2 and 4.

Blank 26 has four longitudinal crease lines 27, and four transverse crease lines 28 perpendicular to longitudinal crease lines 27.

Transverse crease lines 28 define, on blank 26 and between two first longitudinal crease lines 27, a panel 6' forming part of top wall 6 of container 4; a panel 7' forming one major lateral wall 7 of container 4; a panel 5' forming bottom wall 5 of container 4; a panel 7" forming the other major lateral wall 7 of container 4; and a panel 6" forming part of top wall 6 of container 4. Transverse crease lines 28 define, on blank 26 and between two second longitudinal crease lines 27, a panel 14' forming one major lateral wall 14 of container 2; a panel 12' forming bottom wall 12 of container 2; and a panel 14" forming the other major lateral wall 14 of container 2.

A first connecting strip 22' extends from panel 7' to panel 14', and is separated from panels 7' and 14' by longitudinal crease lines 27*b* and 27*a*; and a second connecting strip 22" extends from panel 7" to panel 14", and is separated from panels 7" and 14" by longitudinal crease lines 27*b* and 27*a*.

Panel 7' has a wing 8' separated from panel 7' by a longitudinal crease line 27, and which forms part of minor lateral wall 8 of container 4; and panel 7" has a wing 8" separated from panel 7" by a longitudinal crease line 27, and which forms part of minor lateral wall 8 of container 4. Wing 8' comprises two tabs 29, which are located at opposite ends of wing 8', are separated from wing 8' by two transverse crease lines 28, and form respective inner stiffeners of bottom wall 5 and top wall 6 of container 4. A top tab 29 and panel 6' are so shaped as not to overlap when folded onto panel 6" to form top wall 6 of container 4.

Panel 14' has a wing 15' separated from panel 14' by a longitudinal crease line 27 and forming part of a minor lateral wall 15 of container 2; and panel 14" has a wing 15" separated from panel 14" by a longitudinal crease line 27 and forming part of a minor lateral wall 15 of container 2. Wing 15' comprises a tab 30 separated from wing 15' by a transverse crease line 28 and forming an inner stiffener of bottom wall 12 of container 2.

Figure 7:
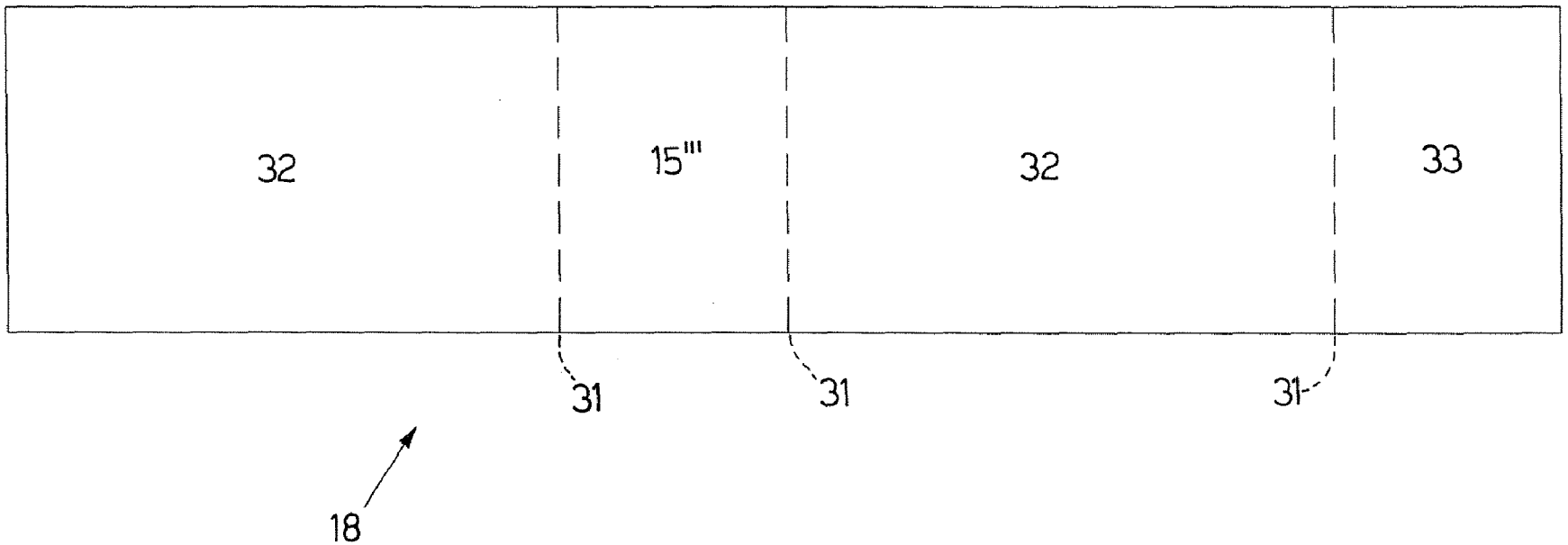
FIG. 7 shows a plan view of a flat collar used in the rigid cigarette packet in FIGS. 1-5.

As stated, container 2 of packet 1 is also formed using inner member 18, which is shown spread out in FIG. 7. Preferably, inner member 18 is supplied flat, as shown in FIG. 7, to a packing unit, which folds inner member 18 into a tube about group 3 of cigarettes; and blank 26 is then folded about group 3 of cigarettes and inner member 18 to form containers 2 and 4. Inner member 18 has three longitudinal crease lines 31, which define a panel 15'" forming one minor lateral wall 15 of container 2; two panels 32 located on opposite sides of panel 15'", and which are glued to the inner surface of major lateral walls 14 of container 2; and a panel 33, which is glued to the other minor lateral wall 15 of container 2. In an alternative embodiment not shown, inner member 18 has no panel 33.

Figure 8:
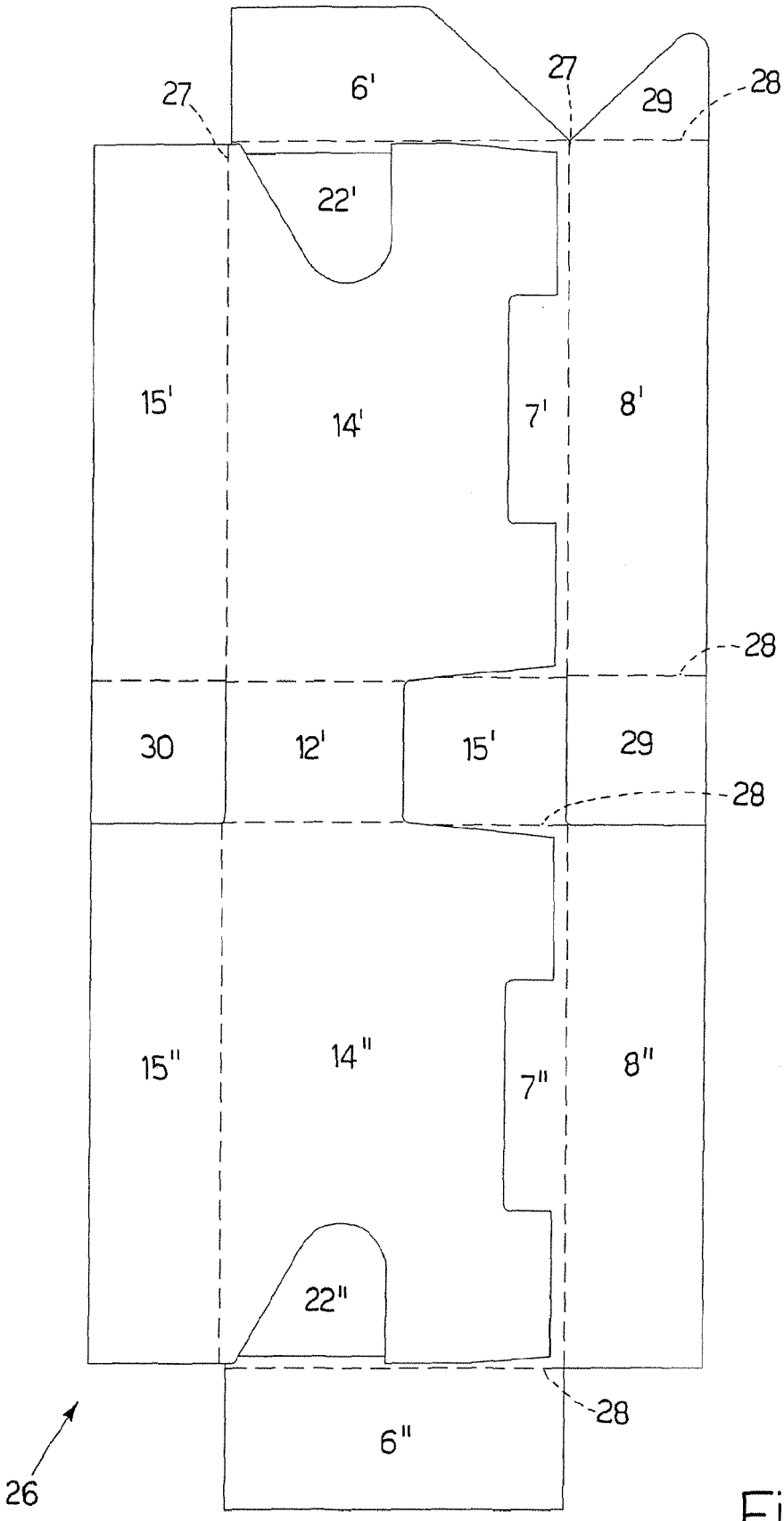
FIG. 8 shows a plan view of the FIG. 6 blank in a flat, partly folded configuration.

To fold blank 26 about group 3 of cigarettes and inner member 18, blank 26 is first folded 180° about longitudinal crease line 27*a* to fold connecting strips 22 onto panels 7' and 7", and is then folded 180° about longitudinal crease line 27*b* to fold panels 14' and 14" onto connecting strips 22, on the opposite side to panels 7' and 7", so that blank 26 assumes the flat, partly folded configuration shown in FIG. 8. The next step is to apply blank 26 to group 3 of cigarettes, already provided with inner member 18, and then fold blank 26 into a U about group 3 of cigarettes, by folding panel 7', together with panel 14', squarely with respect to panel 5' and panel 12', and folding panel 7", together with panel 14", squarely with respect to panel 5' and panel 12'. Next, tabs 29 are folded squarely with respect to wing 8', and tab 30 is folded squarely with respect to wing 15'; wings 8' and 8" are then folded squarely with respect to panels 7' and 7" and one on top of the other, and wings 15' and 15" are folded squarely with respect to panels 14' and 14" and one on top of the other. And finally, panels 6' and 6" are folded squarely with respect to panel 7' and 7" and one on top of the other.

The packing unit for folding blank 26 about group 3 of cigarettes and about inner member 18 may be supplied with blank 26 completely flat as shown in FIG. 6, or in the flat, partly folded configuration shown in FIG. 8. An important point to note is that, in the flat, partly folded configuration shown in FIG. 8, blank 26 is the same shape and size as a standard blank for producing an ordinary rigid, hinged-lid packet, so that packet 1 as described above can be produced on a standard packing machine with very few alterations. Another important point to note is that a standard packing machine provides for supplying a collar, which is folded about the group of cigarettes before the main blank is folded, so that handling inner member 18 as described above is also already provided for on a standard packing machine.

Figure 9:
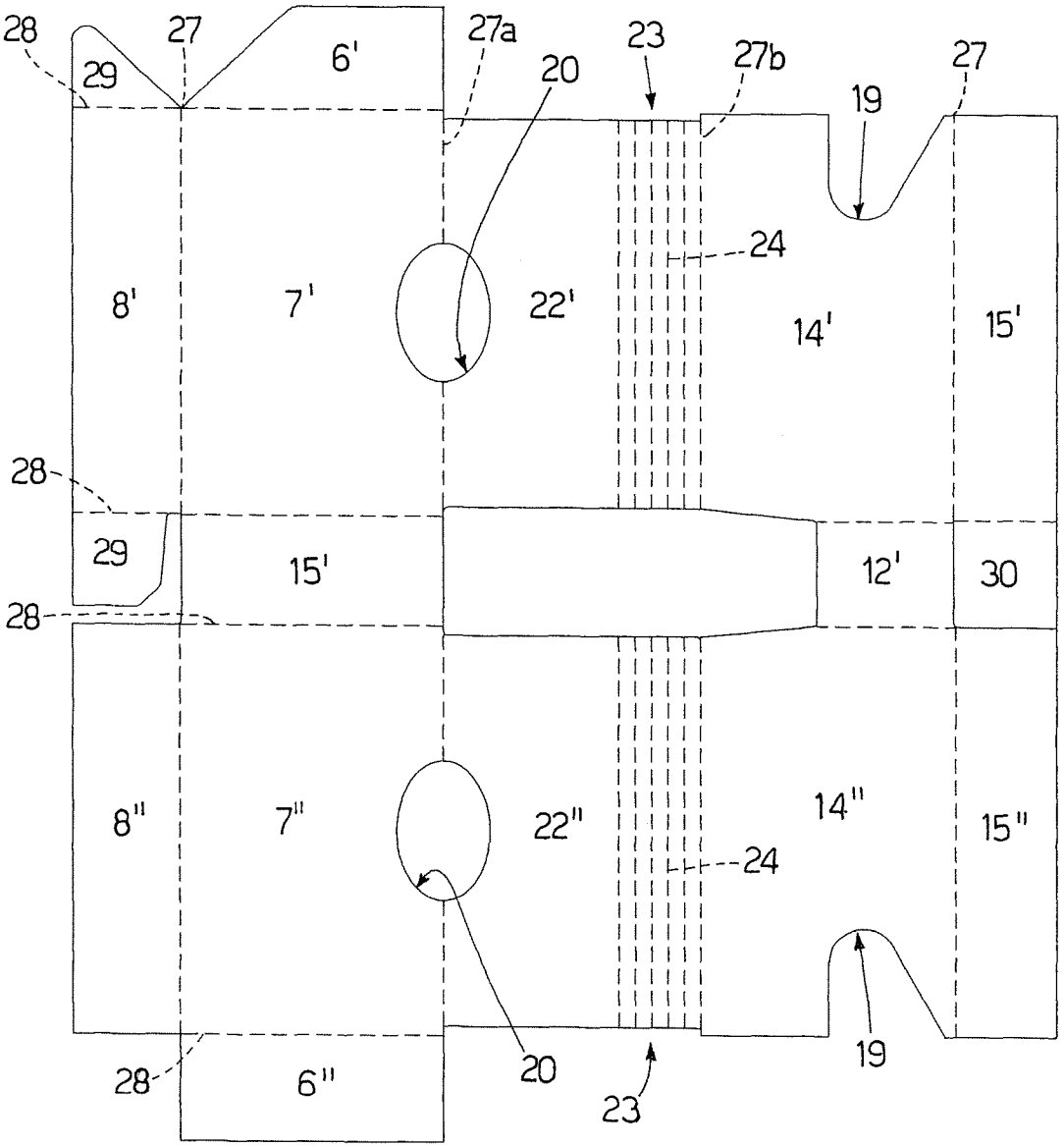
FIG. 9 shows a plan view of an alternative embodiment of a flat blank for producing the rigid cigarette packet in FIGS. 1-5.

FIG. 9 shows an alternative embodiment of a blank 26 for producing packet 1 as described above and shown in FIGS. 1-5. Blank 26 in FIG. 9 differs from blank 26 in FIG. 6 as regards the shape of one tab 29, the different spacing of crease lines 24 of deformable portions 23 of connecting strips 22' and 22", and by having no central holes 25 in deformable portions 23 of connecting strips 22' and 22".

Figure 11:
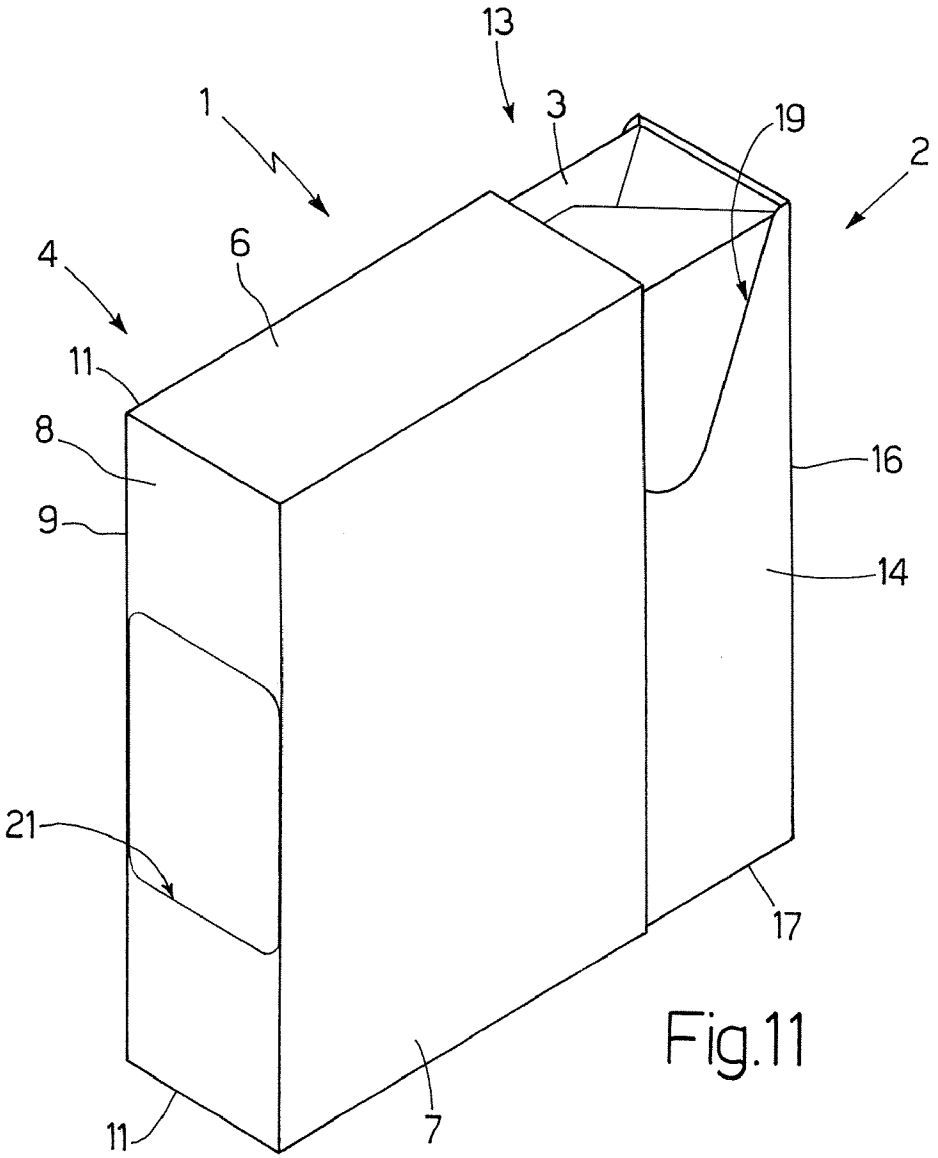
FIG. 11 shows a rear view in perspective of the FIG. 10 rigid cigarette packet in an open configuration.
Figure 10:
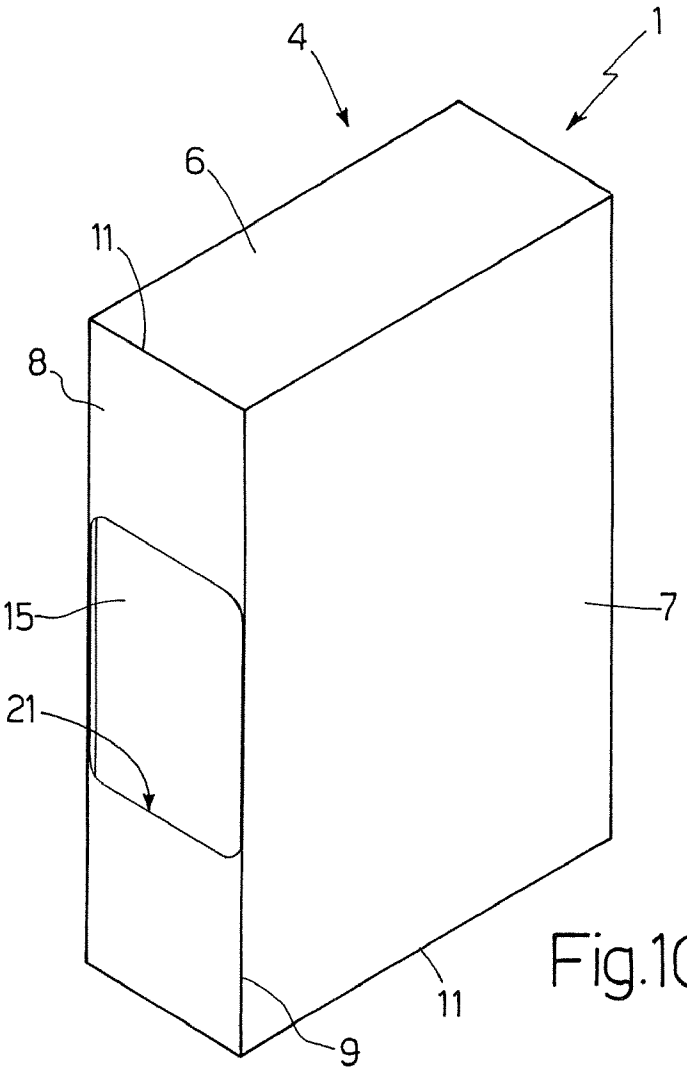
FIG. 10 shows a rear view in perspective of an alternative embodiment of a rigid cigarette packet in accordance with the present invention and in a closed configuration.

FIGS. 10 and 11 show an alternative embodiment of packet 1 as described above and shown in FIGS. 1-5. The main difference between the FIG. 1-5 packet 1 and the FIGS. 10 and 11 packet 1 lies in the FIG. 1-5 packet 1 comprising two recesses 20 to facilitate withdrawal of container 2 from container 4, whereas the FIGS. 10 and 11 packet 1 comprises hole 21 to facilitate expulsion of container 2 from container 4. Also, in the FIG. 1-5 packet 1, one minor lateral wall 15 of container 2 is defined by inner member 18, whereas the FIGS. 10 and 11 packet 1 has no inner member 18, and both the minor lateral walls 15 of container 2 are defined by parts of blank 26 shown in FIG. 12.

Figure 12:
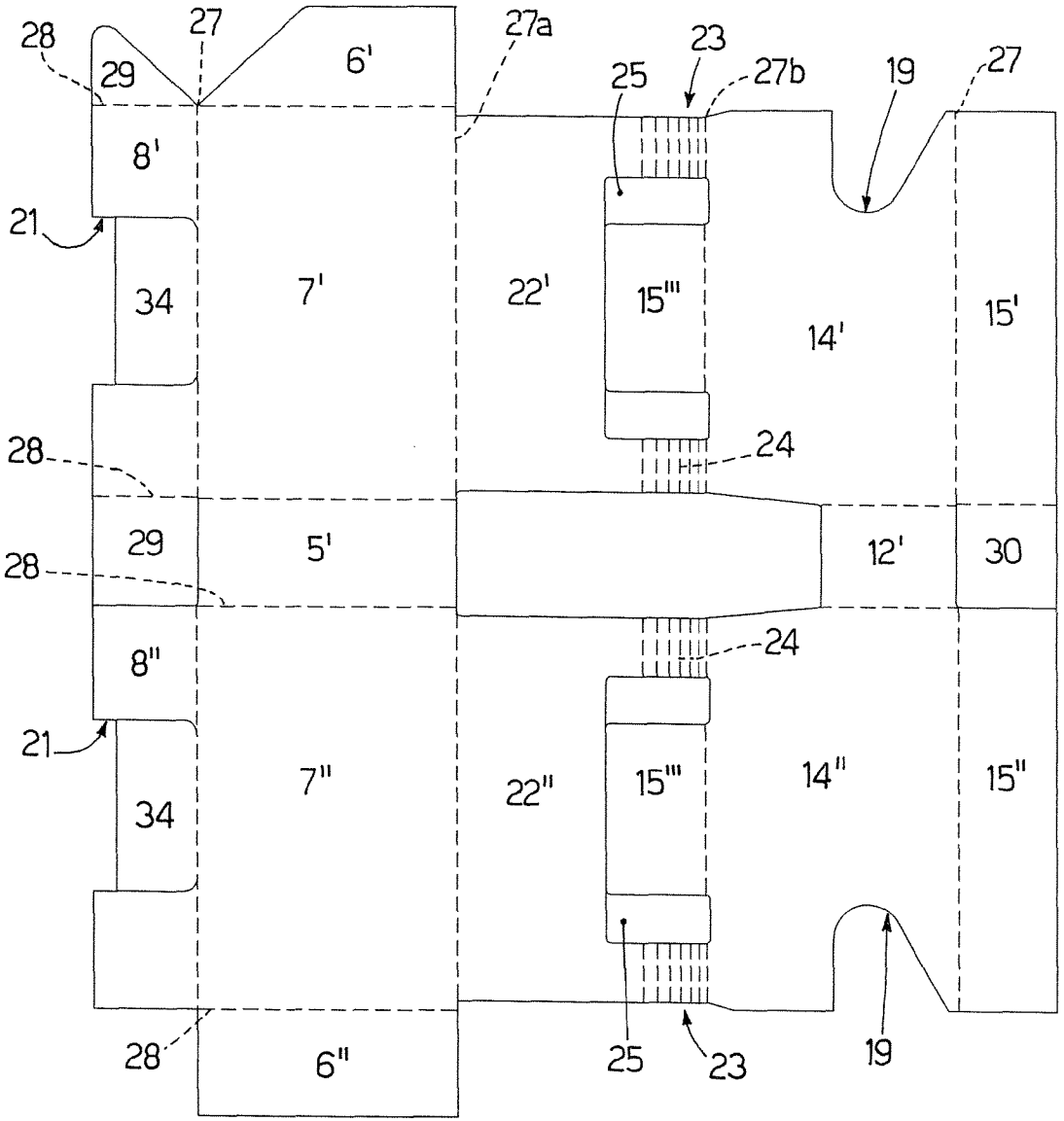
FIG. 12 shows a plan view of a blank for producing the rigid cigarette packet in FIGS. 10 and 11.

Blank 26 in FIG. 12 differs from blank 26 in FIG. 6 by wings 8' and 8" comprising two openings defining hole 21, and by holes 25 in deformable portions 23 of connecting strips 22 containing two wings 15''' and 15''''. More specifically, in the FIG. 12 blank 26, panel 14' has two wings 15' and 15''' located on opposite sides of panel 14', separated from panel 14' by two longitudinal crease lines 27, and forming part of minor lateral walls 15 of container 2; and panel 14" has two wings 15" and 15'''' located on opposite sides of panel 14", separated from panel 14" by two longitudinal crease lines 27, and forming part of minor lateral walls 15 of container 2. Wings 15''' and 15'''' are longitudinally smaller than wings 15' and 15", and, as stated, are located inside central holes 25 in deformable portions 23 of connecting strips 22.

The openings in wings 8' and 8" defining hole 21 may contain further tabs 34 (not shown in FIGS. 10 and 11) connected to panels 7' and 7" and separated from panels 7' and 7" by a longitudinal crease line 27. When folding blank 26, tabs 34 are folded 180° onto panels 7' and 7", and are glued to panels 7' and 7" to locally strengthen panels 7' and 7".

In the embodiments shown in the accompanying drawings, edges 16 and 17 of container 2 and edges 9 and 11 of container 4 are all square edges. In an alternative embodiment not shown, the four longitudinal edges 16 of container 2 and the two longitudinal edges 9 of container 4 are non-square, rounded or bevelled edges. Alternatively, the transverse edges 11 of container 4 and the transverse edges 17 of container 2 may be non-square, rounded or bevelled edges as in the packet of cigarettes described in Patent Application EP-A1-0764595; and both transverse edges 11 and/or 17 and longitudinal edges 9 and/or 16 may be non-square, rounded or bevelled edges.

In an alternative embodiment not shown, each major lateral wall 14 of container 2 is outwardly convex, is connected to each minor lateral wall 15 along a sharp longitudinal edge 16, and forms an obtuse dihedral angle with each minor lateral wall 15. Each major lateral wall 14 of container 2 comprises a flat central portion, and two creased lateral bands with longitudinal crease lines; and each lateral band is curved with its concavity facing inwards to connect the central portion to minor lateral wall 15, and forms an obtuse dihedral angle with minor lateral wall 15.

Each major lateral wall 7 of container 4 is outwardly convex, is connected to minor lateral wall 8 along a sharp longitudinal edge 9, and forms an obtuse dihedral angle with minor lateral wall 8. More specifically, each major lateral wall 7 of container 4 comprises a flat central portion, and a creased lateral band with longitudinal crease lines; and the lateral band is curved with its concavity facing inwards to connect the central portion to minor lateral wall 8, and forms an obtuse dihedral angle with minor lateral wall 8.

Each wall 5, 6 is substantially rectangular, and has two bevelled corners to adapt to the outwardly convex shape of major lateral walls 7. This embodiment is similar to the packet of cigarettes described in Patent Application EP-A1-1066206, and which comprises an outwardly convex front wall and rear wall, each of which has a flat central portion, and two curved, creased lateral bands connecting the flat central portion to two flat lateral walls of the packet along sharp longitudinal edges.

In a further embodiment not shown, each major lateral wall 14 of container 2 is outwardly convex, is connected to bottom wall 12 along a sharp transverse edge 17, and forms an obtuse dihedral angle with bottom wall 12. More specifically, each major lateral wall 14 of container 2 comprises a flat central portion, and a creased lateral band with transverse crease lines; and the lateral band is curved with its concavity facing inwards to connect the central portion to bottom wall 12, and forms an obtuse dihedral angle with bottom wall 12.

Each major lateral wall 7 of container 4 is outwardly convex, is connected to bottom wall 5 or top wall 6 along a sharp transverse edge 11, and forms an obtuse dihedral angle with bottom wall 5 or top wall 6. More specifically, each major lateral wall 7 of container 4 comprises a flat central portion, and two creased lateral bands with transverse crease lines; and each lateral band is curved with its concavity facing inwards to connect the central portion to bottom wall 5 or top wall 6, and forms an obtuse dihedral angle with bottom wall 5 or top wall 6. Minor lateral wall 8 is substantially rectangular, and has bevelled corners to adapt to the outwardly convex shape of major lateral walls 7. This embodiment is similar to the packet of cigarettes described in Patent Application IT-BO2001A000584, and which comprises an outwardly convex front wall and rear wall, each of which has a flat central portion, and two curved, creased lateral bands connecting the flat central portion to two flat walls of the packet along sharp transverse edges.

Clearly, changes may be made to packet 1 as described above, such as forming partly convex walls, or only one convex wall as opposed to two opposite, facing, convex walls.

In view of the numerous advantages of cigarette packets 1 as described above, the form of packets 1 may also be applied integrally to the manufacture of other types of rigid containers for tobacco articles, such as a cigarette carton or a cigar packet.

The invention claimed is:

1. A rigid package for tobacco articles, the package (1) comprising:

a first container (2) housing a group (3) of tobacco articles; and a second container (4) housing the first container (2) in sliding manner to enable the first container (2) to slide, with respect to the second container (4), between a closed position, in which the first container (2) is fully inserted inside the second container (4), and an open position, in which the first container (2) is partly extracted from the second container (4);

wherein each container (2; 4) is parallelepiped-shaped, and has two parallel, opposite, major lateral walls (14; 7) laterally enclosing the group (3) of tobacco articles; and the package (1) being characterized by comprising two connecting strips (22), each of which is connected, on one side, to a major lateral wall (14) of the first container (2), and, on the opposite side, to a major lateral wall (7) of the second container (4), and comprises a deformable portion (23) at the first container (2);

wherein each connecting strip (22) is arranged between the major lateral walls (14, 7) of the containers (2, 4) and has a U-shaped configuration; wherein the second container (4) comprises a bottom wall (5); a top wall (6); a minor lateral wall (8) separated from the major lateral walls (7) by two longitudinal edges (9); and an open end (10) parallel to and opposite the minor lateral wall (8) and permitting passage of the first container (2); and the first container (2) comprises two parallel, opposite, minor lateral walls (15) separated from the major lateral walls (14) by four longitudinal edges (16); a bottom wall (12); and a withdrawal opening (13) parallel to and opposite the bottom wall (12); wherein both the containers (2, 4) are formed from the same flat blank (26) having four longitudinal crease lines (27) and four transverse crease lines (28); the transverse crease lines (28) define, on the blank (26) and between two first longitudinal crease lines (27), a first panel (6') forming part of the top wall (6) of the second container (4); a second panel (7') forming one major lateral wall (7) of the second container (4); a third panel (5') forming the bottom wall (5) of the second container (4); a fourth panel (7") forming the other major lateral wall (7) of the second container (4); and a fifth panel (6") forming part of the top wall (6) of the second container (4); the transverse crease lines (28) define, on the blank (26) and between two second longitudinal crease lines (27), a sixth panel (14') forming one major lateral wall (14) of the first container (2); a seventh panel (12') forming the bottom wall (12) of the first container (2); and an eighth panel (14") forming the other major lateral wall (14) of the first container (2).

2. A package as claimed in claim 1, wherein each connecting strip (22) is connected to the major lateral wall (14) of the first container (2) at an end edge of the major lateral wall (14).

3. A package as claimed in claim 1, wherein each connecting strip (22) is connected seamlessly to the major lateral wall (14) of the first container (2).

4. A package as claimed in claim 1, wherein each connecting strip (22) is connected to the major lateral wall (7) of the second container (4) at an end edge of the major lateral wall (7).

5. A package as claimed in claim 1, wherein each connecting strip (22) is connected seamlessly to the major lateral wall (7) of the second container (4).

6. A package as claimed in claim 1, wherein the deformable portion (23) of each connecting strip (22) has a number of parallel, spaced crease lines (24).

7. A package as claimed in claim 1, wherein, when the first container (2) is in the closed position, the deformable portion (23) of each connecting strip (22) is fully extended, assumes a flat configuration, and is parallel to the major lateral walls (14, 7) of the containers (2, 4); and, when the first container (2) is in the open position, the deformable portion (23) of each connecting strip (22) assumes a U-shaped configuration.

8. A package as claimed in claim 1, wherein each connecting strip (22), with the exception of the deformable portion (23), is glued to the inner surface of the major lateral wall (7) of the second container (4).

9. A package as claimed in claim 1, wherein the second container (4) comprises a minor lateral wall (8) separated from the major lateral walls (7) by two longitudinal edges (9); and an open end (10) parallel to and opposite the minor lateral wall (8) and permitting passage of the first container (2); the minor lateral wall (8) of the second container (4) having at least one through hole (21) sized to permit insertion of a user's finger.

10. A package as claimed in claim 1, wherein the second container (4) comprises a minor lateral wall (8) separated from the major lateral walls (7) by two longitudinal edges (9); and an open end (10) parallel to and opposite the minor lateral wall (8) and permitting passage of the first container (2); each major lateral wall (7) of the second container (4) having a recess (20) close to the open end (10).

11. A package as claimed in claim 1, wherein a first minor lateral wall (15) of the first container (2), facing the open end (10) of the second container (4), is the same size as the minor lateral wall (8) of the second container (4), and is larger than a second minor lateral wall (15) of the first container (2), facing the minor lateral wall (8) of the second container (4).

12. A package as claimed in claim 11, wherein the second minor lateral wall (15) of the first container (2) is defined by an annular member (18) looped about the group (3) of tobacco articles and glued to the inner surface of the major lateral walls (14) or of the first minor lateral wall (15) of the first container (2).

13. A package as claimed in claim 1, wherein the bottom wall (12) of the first container (2) is smaller than the bottom wall (5) of the second container (4).

14. A package as claimed in claim 1, wherein each major lateral wall (14) of the first container (2) has a recess (19) at the top.

15. A package as claimed in claim 1, wherein each connecting strip (22) is slightly smaller longitudinally than the major lateral walls (7, 14) of the containers (4, 2).

16. A package as claimed in claim 15, wherein each connecting strip (22) has a central hole (25) at the deformable portion (23).

17. A package as claimed in claim 1, wherein a first connecting strip (22') extends from the second panel (7') to the sixth panel (14'), and is separated from the second and sixth panel (7', 14') by respective longitudinal crease lines (27); and a second connecting strip (22") extends from the fourth panel (7") to the eighth panel (14"), and is separated from the fourth and eighth panel (7", 14") by respective longitudinal crease lines (27).

18. A package as claimed in claim 17, wherein the blank (26) has a flat, partly folded configuration, in which the connecting strips (22', 22") are folded 180° about a longitudinal crease line (27*a*) onto the second and fourth panel (7', 7"), and the sixth and eighth panel (14', 14") are folded 180° about a further longitudinal crease line (27*b*) onto the connecting strips (22', 22") on the opposite side to the second and fourth panel (7', 7").

19. A package as claimed in claim 18, wherein the connecting strips (22', 22"), with the exception of the deformable portions (23), are glued to the second and fourth panel (7', 7").

20. A package as claimed in claim 1, wherein the second panel (7') has a first wing (8') separated from the second panel (7') by a longitudinal crease line (27) and forming part of the minor lateral wall (8) of the second container (4); and the fourth panel (7") has a second wing (8") separated from the fourth panel (7") by a longitudinal crease line (27) and forming part of the minor lateral wall (8) of the second container (4).

21. A package as claimed in claim 20, wherein the first wing (8') comprises two first tabs (29) located at opposite ends of the first wing (8'), separated from the first wing (8') by two transverse crease lines (28), and forming respective inner stiffeners of the bottom wall (5) and top wall (6) of the second container (4).

22. A package as claimed in claim 21, wherein a first top tab (29) and the first panel (6') are so shaped as not to overlap when folded onto the fifth panel (6") to form the top wall (6) of the second container (4).

23. A package as claimed in claim 20, wherein the minor lateral wall (8) of the second container (4) has at least one through hole (21) sized to permit insertion of a user's finger; the first wing (8') and the second wing (8") comprising respective openings defining the through hole (21) in the minor lateral wall (8) of the second container (4); and two second tabs (34) are provided, are connected to the second and fourth panel (7', 7"), and are separated from the second and fourth panel (7', 7") by a longitudinal crease line (27).

24. A package as claimed in claim 23, wherein, as the blank (26) is folded, the second tabs (34) are folded 180° onto the second and fourth panel 7', 7"), and are glued to the second and fourth panel (7', 7") to locally stiffen the second and fourth panel (7', 7").

25. A package as claimed in claim 1, wherein the sixth panel (14') has a third wing (15') separated from the sixth panel (14') by a longitudinal crease line (27) and forming part of a minor lateral wall (15) of the first container (2); and the eighth panel (14") has a fourth wing (15") separated from the eighth panel (14") by a longitudinal crease line (27) and forming part of a minor lateral wall (15) of the first container (2).

26. A package as claimed in claim 24, wherein the third wing (15') comprises a third tab (30) separated from the third wing (15') by a transverse crease line (28) and forming an inner stiffener of the bottom wall (12) of the first container (2).

27. A package as claimed in claim 1, wherein a minor lateral wall (15) of the first container (2) is defined by an annular member (18), which is separate from the blank (26), is looped about the group (3) of tobacco articles, and is glued to the inner surface of the major lateral walls (14) or of the first minor lateral wall (15) of the first container (2).

28. A package as claimed in claim 1, wherein each connecting strip (22', 22") has a central hole (25) at the deformable portion (23); the sixth panel (14') has a third wing (15') and a fifth wing (15'''), which are located on opposite sides of the sixth panel (14'), are separated from the sixth panel (14') by two longitudinal crease lines (27), and form part of the minor lateral walls (15) of the first container (2); the eighth panel (14") has a fourth wing (15") and a sixth wing (15""), which are located on opposite sides of the eighth panel (14"), are separated from the eighth panel (14") by two longitudinal crease lines (27), and form part of the minor lateral walls (15) of the first container (2); and the fifth wing (15''') and sixth wing (15"") are smaller longitudinally than the third wing (15') and fourth wing (15"), and are located inside the central holes (25) in the deformable portions (23) of the connecting strips (22', 22").

* * * * *